US012203210B2

(12) United States Patent
Park et al.

(10) Patent No.: US 12,203,210 B2
(45) Date of Patent: Jan. 21, 2025

(54) CLOTHES TREATMENT APPARATUS

(71) Applicant: LG Electronics Inc., Seoul (KR)

(72) Inventors: Sunghoo Park, Seoul (KR); Wansik Nam, Seoul (KR); Jaehyoung Park, Seoul (KR); Chaewon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/482,449

(22) Filed: Oct. 6, 2023

(65) Prior Publication Data

US 2024/0035230 A1 Feb. 1, 2024

Related U.S. Application Data

(63) Continuation of application No. 17/634,813, filed as application No. PCT/KR2020/010747 on Aug. 13, 2020, now Pat. No. 11,795,609.

(30) Foreign Application Priority Data

Aug. 13, 2019 (KR) ..... 10-2019-0099024
Aug. 13, 2019 (KR) ..... 10-2019-0099025

(51) Int. Cl.
*D06F 71/40* (2006.01)
*D06F 58/10* (2006.01)
(Continued)

(52) U.S. Cl.
CPC ..... *D06F 71/40* (2013.01); *D06F 58/10* (2013.01); *D06F 71/285* (2013.01); *D06F 71/29* (2013.01); *D06F 71/36* (2013.01)

(58) Field of Classification Search
CPC ..... D06F 71/40; D06F 71/285; D06F 71/29; D06F 71/36; D06F 58/10
See application file for complete search history.

(56) References Cited

U.S. PATENT DOCUMENTS 4,694,146 A 9/1987 DeMars
5,815,961 A 10/1998 Estes et al.
(Continued)

FOREIGN PATENT DOCUMENTS

CN 102839528 12/2012
CN 204097773 1/2015
(Continued)

OTHER PUBLICATIONS

Office Action in Japanese Appln. No. 2023-202871, mailed on Jun. 18, 2024, 12 pages (with English translation).
(Continued)

*Primary Examiner* — Ismael Izaguirre
(74) *Attorney, Agent, or Firm* — Fish & Richardson P.C.

(57) ABSTRACT

A clothes treatment apparatus includes a cabinet, a door having clothes fixing parts, and a press device disposed below the clothes fixing parts on an inner surface of the door. The press device includes a base plate which is disposed on the inner surface of the door, and which supports one side of the clothes hung on the clothes fixing parts, a press plate which is hinge-fixed to one side of the door, and which brings the clothes hung on the clothes fixing parts into close contact with the base plate, and a film which is fixedly disposed at the end portion of the base plate, which is extended to the center of the base plate, and which is disposed between the press plate and the base plate when the press plate is in close contact with the base plate.

17 Claims, 16 Drawing Sheets

(51) Int. Cl.

| | |
|---|---|
| ***D06F 71/28*** | (2006.01) |
| ***D06F 71/29*** | (2006.01) |
| ***D06F 71/36*** | (2006.01) |

(56) References Cited

U.S. PATENT DOCUMENTS

| | | | | |
|---|---|---|---|---|
| D732,772 | S * | 6/2015 | Chung | D32/25 |
| 2015/0020419 | A1* | 1/2015 | Park | D06F 71/30 38/3 |
| 2015/0159315 | A1 | 6/2015 | Lim et al. | |
| 2018/0148887 | A1 | 5/2018 | Choi et al. | |

FOREIGN PATENT DOCUMENTS

| | | | | |
|---|---|---|---|---|
| CN | 205099991 | | 3/2016 | |
| EP | 3321413 | A1 * | 5/2018 | D06F 35/00 |
| EP | 3575480 | A1 * | 12/2019 | D06B 23/04 |
| GB | 599753 | | 3/1948 | |
| GB | 2259716 | | 3/1993 | |
| JP | S49-029291 | U | 3/1974 | |
| JP | S52-104012 | | 9/1977 | |
| JP | S54-032384 | | 3/1979 | |
| JP | S54-038691 | U | 3/1979 | |
| JP | S58-020419 | | 2/1983 | |
| JP | S58-071392 | U | 5/1983 | |
| JP | S58-081095 | | 5/1983 | |
| JP | S59-127277 | | 8/1984 | |
| JP | H04-008995 | | 1/1992 | |
| JP | H05-061374 | | 8/1993 | |
| JP | H07-119348 | | 5/1995 | |
| JP | H08-024498 | | 1/1996 | |
| JP | H10-165698 | | 6/1998 | |
| JP | 2000-107496 | A | 4/2000 | |
| JP | 2018-503430 | | 2/2018 | |
| KR | 10-1993-0011189 | | 6/1993 | |
| KR | 10-0662288 | | 6/2002 | |
| KR | 10-2012-0091799 | | 8/2012 | |
| KR | 10-2016-0075032 | | 6/2016 | |
| KR | 10-2018-0052954 | | 5/2018 | |
| KR | 10-2019-0018143 | A | 2/2019 | |
| WO | WO 2018/038580 | | 3/2018 | |

OTHER PUBLICATIONS

Office Action in Korean Appln. No. 10-2019-0099025, mailed on Aug. 9, 2024, 8 pages (with English Translation).

Extended European Search Report in Appln. No. 20851608.8, dated Jul. 5, 2023, 9 pages.

International Search Report in Appln. No. PCT/KR2020/010747, dated Dec. 2, 2020, 19 pages (with English translation).

Office Action in Chinese Appln. No. 202080057164.1, dated Mar. 29, 2023, 19 pages (with English translation).

Office Action in Japanese Appln. No. 2022-508790, dated Apr. 11, 2023, 12 pages (with English translation).

Notice of Allowance in Japanese Appln. No. 2022-508790, mailed on Oct. 31, 2023, 7 pages (with English translation).

* cited by examiner

CLOTHES TREATMENT APPARATUS

CROSS-REFERENCE TO RELATED APPLICATIONS

This application is a continuation of U.S. application Ser. No. 17/634,813, filed on Feb. 11, 2022, which is a National Stage application under 35 U.S.C. § 371 of International Application No. PCT/KR2020/010747, filed on Aug. 13, 2020, which claims the benefit of Korean Application Nos. 10-2019-0099025, filed on Aug. 13, 2019, and 10-2019-0099024, filed on Aug. 13, 2019. The disclosures of the prior applications are incorporated by reference in their entirety.

TECHNICAL FIELD

The present disclosure relates to a laundry treatment apparatus, and more particularly, to a laundry treatment apparatus including a press device for pressurizing laundry.

BACKGROUND

Laundry treatment apparatuses mean apparatuses for managing laundry through washing, drying, wrinkle removal, etc., at home, a laundry cleaner, and the like.

For example, laundry treatment apparatuses include a washing machine for washing laundry, a dryer for drying laundry, a drying washing machine equipped with both washing and drying functions, a refresher for refreshing laundry, a steamer for removing unnecessary wrinkles of laundry, etc.

A refresher is a device for pleasantly refreshing a state of laundry, and functions to dry the laundry, supply fragrance to the laundry, prevent generation of static electricity of the laundry, or remove wrinkles of the laundry.

A laundry treatment apparatus having a steamer and a refresher is disclosed in Korean Patent Laid-Open Gazette No. 10-2014-0184457. The laundry treatment apparatus consists of a treatment chamber for treating laundry by air circulation or steam and a separate pants sharp crease module for forming sharp creases by pressurizing laundry such as pants and the like in the treatment chamber.

However, when pants including a pair of sleeves are disposed in the pants sharp crease modules, since a pair of the sleeves are disposed to overlap each other inside the pants sharp crease module, the pants are not firmly disposed, thereby causing a problem of forming double creases n the pants.

SUMMARY

One technical task of the present disclosure is to provide a laundry treatment apparatus capable of effectively pressurizing laundry including a pair of sleeves.

According to the present disclosure, a film is disposed between a pair of sleeves, whereby laundry can be effectively pressurized. Yet, it may be inconvenient for a user to dispose the film between a pair of the sleeves. Another technical task of the present disclosure is to provide a laundry treatment apparatus having a structure for facilitating a user to dispose a film between a pair of sleeves.

In addition, regarding a film disposed between a pair of sleeves, since the film is disposed between a pair of the sleeves, there may be limitations in size or material. When the film with such material and thickness is disposed in a press device for applying pressure, there may be a problem of separation from the press device. Another technical task of the present disclosure is to provide a laundry treatment apparatus capable of fixing a film to a press device stably.

It will be appreciated by persons skilled in the art that the technical tasks that could be achieved with the present disclosure are not limited to what has been particularly described hereinabove and the above and other technical tasks that the present disclosure could achieve will be more clearly understood from the following detailed description.

In one technical aspect of the present disclosure, provided is an apparatus for treating laundry, the apparatus including a cabinet having a treatment space for receiving the laundry therein and an open front side, a door opening/closing the open front side of the cabinet and having a laundry fixing part disposed thereto to have the laundry hung up thereon, and a press device disposed on an inner surface of the door facing the treatment space under the laundry fixing part to pressurize the laundry hung up on the laundry fixing part.

To achieve the task of effective pressurization of the laundry, the press device of the apparatus according to the present disclosure may include a base plate disposed on the inner surface of the door to support one side of the laundry hung up on the laundry fixing part, a press plate hinged to one side of the door to enable the laundry hung up on the laundry fixing part to adhere to the base plate, and a film stationarily disposed to an end portion of the base plate, extended toward a center of the base plate, and disposed between the press plate and the base plate when the press plate adheres to the base plate.

Particularly, the film is disposed between a pair of sleeves of the laundry including a pair of the sleeves, thereby pressurizing each of a pair of the sleeves.

The base plate may include a first surface facing the press plate and a second surface disposed in a direction opposite to the first surface.

The press device may include a bracket connected to the film and rotatably mounted on an end portion of the base plate and a shaft disposed rotatably to the base plate to rotate the bracket, thereby changing disposition of the film disposed on the first surface of the base plate.

The film and the bracket may be disposed on the first surface by being connected together, and the bracket and the shaft may be disposed on the second surface by being connected together.

A shaft fixing member rotatably fixing the shaft may be disposed on the second surface and a movement restricting rib restricting a height-directional movement of the shaft may be disposed at each of a top end and a bottom end of the shaft on the second surface, whereby the shaft may rotate stably.

The base plate may include a base fixing plate fixed to the door and a base elastic plate extended from the base fixing plate in left and right directions and disposed to be spaced apart from the inner surface of the door, the film may be disposed on the base elastic plate, and thus the film is disposed on the base elastic plate that pressurizes the laundry.

A hinge rotatably disposing the press plate to the door may be disposed on one side of the press plate, a switch part fastening/unfastening the press plate to/from the door may be disposed on the other side of the press plate, the laundry disposed between the base plate and the press plate may be pressurized when the switch part fastens the press plate to the door, and thus the laundry may be pressurized when the press plate is fastened to the door.

The press plate may include a pressurizing plate pressurizing the base elastic plate when the switch part fastens the press plate to the door, an opening for air flowing in the treatment space to flow into the laundry disposed in the press device may be formed between the pressurizing plate, and thus the steam flowing in the treatment space may flow into the laundry disposed in the press device.

The bracket may include an inner bracket disposed in a direction faced by the second surface to be connected to the shaft, an outer bracket disposed in a direction faced by the first surface to be connected to the film, and a connecting bracket vertically connecting the inner bracket and the outer bracket together, thereby changing disposition of the film disposed on the first surface.

An end portion of one side of the inner bracket may be bonded to the shaft to restrict a rotation range of the shaft, thereby preventing the film from excessively moving on the first surface of the base plate.

The film may be bonded to one side of the outer bracket via an adhesive member and formed of a flexible material.

The film may include a first film rotatably disposed to a left end portion of the base plate and a second film rotatably disposed to a right end portion of the base plate, and thus the film may be inserted in both sides of a pair of sleeves included in the laundry.

In another technical aspect of the present disclosure, provided is an apparatus for treating laundry, the apparatus including a cabinet having a treatment space for receiving the laundry therein and an open front side, a door opening/closing the open front side of the cabinet and having a laundry fixing part disposed thereto to have the laundry hung up thereon, and a press device disposed on an inner surface of the door facing the treatment space under the laundry fixing part to pressurize the laundry hung up on the laundry fixing part, the press device including a base plate disposed on the inner surface of the door to support one side of the laundry hung up on the laundry fixing part, a press plate hinged to one side of the door to enable the laundry hung up on the laundry fixing part to adhere to the base plate, a film disposed between the press plate and the base plate, and a bracket fixing the film to the base plate, whereby each of a pair of sleeves may be pressurized in a manner of disposing the film in the laundry such as pants having a pair of the sleeves and applying pressure to the press plate and the base plate.

The bracket may be stationarily disposed to an end portion of one side of the base plate and connected to the film by being bonded thereto, and thus the film may be stably fixed to the base plate.

A fixing rib fixing the bracket to a rear side having the film disposed thereon may be formed on the base plate, and thus the bracket may be fixed to the base plate.

The bracket may include an inner bracket disposed on one side of the base plate facing the door to be fixed to the base plate, an outer bracket disposed on the other side of the base plate facing the press plate to be connected to the film, and a connecting bracket vertically connecting the inner bracket and the outer bracket together, whereby the inner bracket may be fixed to the base plate and whereby the film may be bonded to the outer bracket.

A fixing rib fixing the inner bracket may be formed on one side of the base plate and a bracket hole having the fixing rib inserted therein may be formed in the inner bracket.

The fixing rib may be coupled to the inner bracket by a hook mechanism, and the bracket may be stationarily disposed to the base plate.

The fixing rib may include a vertical rib extended from one side of the base plate toward the door to pass though the bracket hole, a horizontal rib extended parallel to a surface formed by the inner bracket in a manner of being bent at an end portion of the vertical rib, and a horizontal rib projection project from one side of the horizontal rib in a direction facing the bracket, the horizontal rib projection may come in contact with the inner bracket, and thus the bracket mounted on the base plate may be stably fixed to the base plate.

The inner bracket may include a rib fixing projection projected in a direction of the horizontal rib to be caught on the horizontal rib projection.

The bracket may be connected to the film on one side of the base plate facing the treatment space and rotatably fixed to the base plate on the other side of the base plate facing the door, whereby the film fixed to the bracket may rotate toward a front side of the base plate in a predetermined range.

The bracket may include an outer bracket disposed on one side of the base plate facing the press plate to form a flat surface connected to the film, an inner bracket disposed on the other side of the base plate facing the door, having a semicircular shape convex in a direction of the door, and disposed rotatably to the base plate, and a bracket stopper extended in the direction of the door by being bent at an end portion of the inner bracket to restrict a rotatable range of the bracket, and thus the bracket may rotate in a predetermined range on the base plate.

A bracket hole may be formed in one side of the inner bracket and a fixing projection inserted in the bracket hole may be formed on the base plate to fix one side of the bracket thereto, whereby the bracket may be fixed to the base plate.

A width formed by the bracket hole may become narrower if getting more distant from the base plate, the fixing projection may include a fixing projection body projected from the base plate and disposed by passing through the bracket hole and a fixing projection head formed at an end portion of the fixing projection body and having a width greater than the fixing projection body, a width of the fixing projection head may be formed greater than a width of an outer end portion of the bracket hole, and thus the bracket may be prevented from being separated from the base plate.

Details of other embodiments are included in the detailed description and drawings.

Accordingly, a laundry treatment apparatus of the present disclosure has one or more effects and/or advantages as follows.

First, a film is disposed between a press plate and a base plate, and since the film is disposed between sleeves of laundry having a pair of the sleeves and the press plate and the base plate press the laundry from both sides, movement of the laundry is reduced in a pressurizing process, thereby effectively pressing the laundry and removing wrinkles.

Second, when a film is rotatably disposed on a base plate by a bracket and shaft, since a user can easily insert a film between a pair of sleeves, convenience in use can be provided.

Third, as a bracket is fixed to one side of a base plate and attached to a film on the other side of the base plate, it is advantageous in that the film can be stably fixed to the base plate by the bracket.

Fourth, since a bracket rotates on a base plate in a predetermined range to change the disposition of a film, a film can be easily inserted between a pair of sleeves of laundry mounted on a press device, thereby providing a user with convenience in using the press device.

The effects that can be achieved through the embodiments of the present disclosure are not limited to what has been particularly described hereinabove and other effects which are not described herein can be derived by those skilled in the art from the following detailed description.

DETAILED DESCRIPTION

Figure 1A:
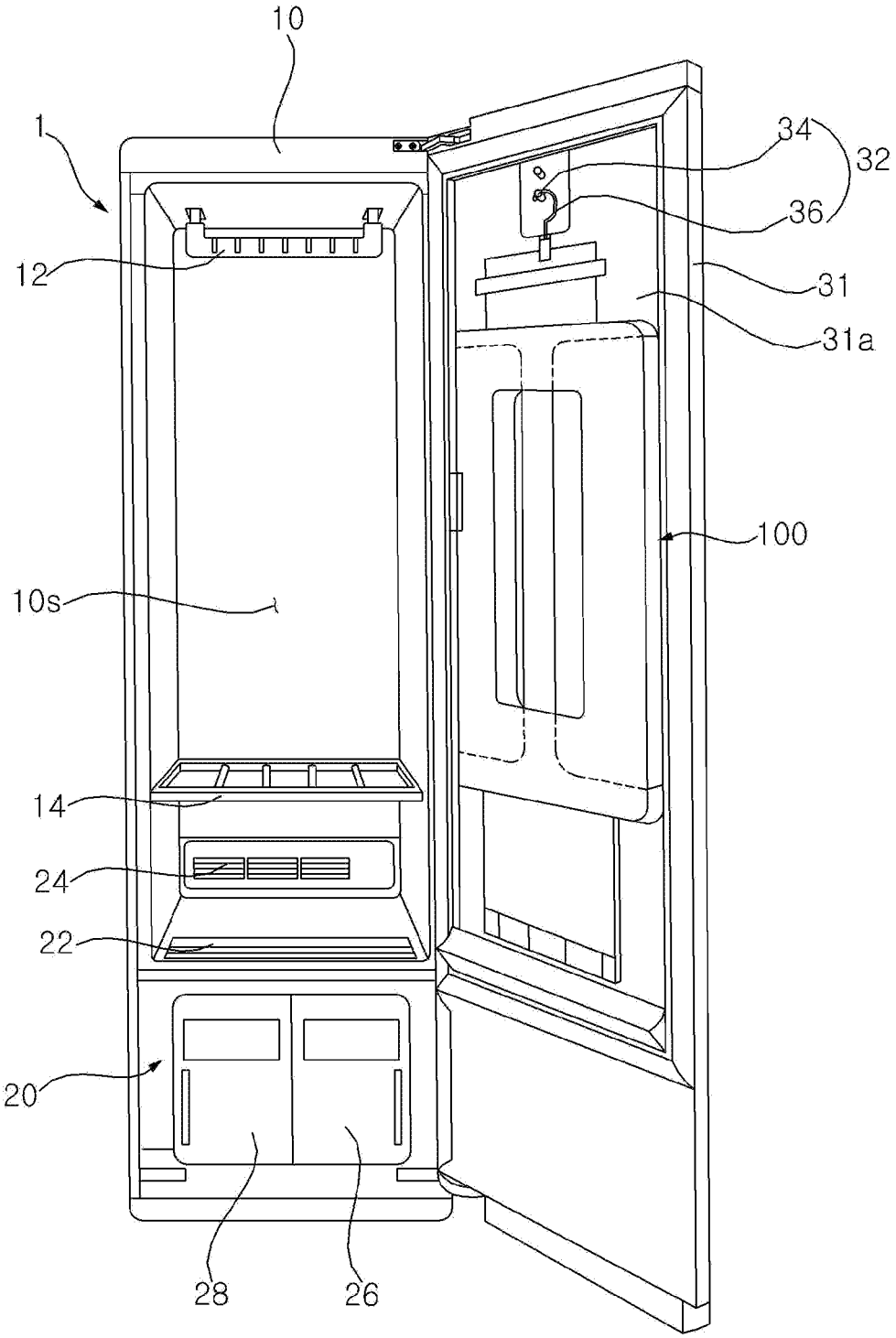
FIG. 1A is a perspective diagram of a laundry treatment apparatus having a door in an open state according to one embodiment of the present disclosure.

Advantages and features of the present disclosure and a method for achieving them will become clear with reference to the embodiments described below in detail together with the accompanying drawings. However, the present disclosure is not limited to the embodiments disclosed below, but may be implemented in various different forms, only to ensure that the disclosure of the present invention is complete and to fully inform the scope of the invention to those skilled in the art, and the present disclosure is defined by the scope of the appended claims. The same reference numbers refer to the same components throughout the specification.

Hereinafter, the present invention will be described with reference to drawings for describing a laundry treatment apparatus according to embodiments of the present disclosure.

<Overall Configuration>

Overall configuration of a laundry treatment apparatus according to the present disclosure will be described with reference to FIGS. 1A to 2B.

*A laundry treatment apparatus 1 of the present disclosure may supply steam or hot air to an object to be treated (hereinafter, referred to as "laundry") such as clothes and the like disposed therein, or may supply dry air at high temperatures thereto. In addition, the laundry treatment apparatus 1 may apply vibration to the laundry disposed therein to shake off foreign substances from the laundry.

The laundry treatment apparatus 1 according to the present disclosure includes a cabinet forming a treatment space 10*s* having targets to be treated such as clothes and the like disposed therein and having an open front side, a door 30 closing/opening the open front side of the cabinet 10, and a mechanical room disposed under the treatment space to circulate air with the treatment space.

In the cabinet 10, a laundry hanging part 12 disposed in an upper part of the treatment space 10*s* to hang laundry received in the treatment space 10*s* and a rack 14 on which small laundry disposed in the treatment space 10*s* is mounted may be disposed.

The laundry hanging part 12 may be vibrated by a vibration module (not shown) disposed inside the cabinet 10. The laundry hanging part 12 shakes the laundry hung on the laundry hanging part 12 by the vibration of the vibration module, thereby shaking off foreign substances from the laundry. The rack 14 is detachably disposed in the treatment space 10*s* of the cabinet 10.

The door 30 includes a door plate 31 covering the front side of the cabinet 10, a press device 100 disposed on an inner surface of the door plate 31 facing the treatment space 10*s* to pressurize laundry, and a laundry fixing part 32 fixing a position of the laundry disposed in the press device 100. The door includes a fixing clip 40 fixed to the laundry fixing part 32 to fix a bottom of laundry disposed downward. The fixing clip 40 is disposed in a manner of being spaced apart from an inner surface 31*a* of the door plate 31 in a predetermined interval, and a user may fix the bottom of the laundry by inserting the bottom of the laundry fixed to the laundry fixing part 32 into a space between the inner surface 31*a* of the door plate 31 and the fixing clip 40.

The laundry fixing part 32 fixes the laundry above the press device 100 to hang down the laundry. The laundry fixing part 32 includes a fixing hook 36 fixing laundry and a fixing peg 34 protruding from the inner surface 31*a* of the door plate 31 toward the treatment space 10*s* to hang up the fixing hook 36 thereon.

The mechanical room 20 is disposed under the treatment space 10*s* inside the cabinet 10 to circulate the air of the treatment space. In the mechanical room 20, an inlet 22 provided to a top side facing the treatment space 22 to suck air into the mechanical room 20 and an outlet 24 discharging the air in the mechanical room 20 into the treatment space 10*s* are formed.

Inside the mechanical room 20, a fan (not shown) enabling air having flown in through the inlet 22 to flow to the outlet 24, an air processing unit (not shown) processing the air having flown into the mechanical room 20, and a steam supply unit (not shown) generating steam by heating water to send the steam to the treatment space 10*s* may be disposed.

The air processing unit send dry hot air to the outlet 24 in a manner of circulating a refrigerant through compression, condensation, expansion and evaporation, condensing the air having flown in through the inlet 22 via heat exchange with the refrigerant, and heating the condensed air.

In the mechanical room 20, a first tank 26 supplying water to the steam supply unit and a second tank 28 storing condensed water generated from condensation of air in the mechanical room 20 therein are included.

<Press Device>

Hereinafter, a press device according to the present embodiment will be described with reference to FIGS. 2A to 6B.

A press device 100 includes a base plate 120 supporting one side of laundry fixed to a laundry fixing part 32, a press plate 110 adhering to the base plate 120, and a film 150*a*/150*b* stationarily disposed to left and right ends of the base plate 120, extended to a center of the base plate 120, and disposed between the base plate 120 and the press plate 110. Laundry fixed to the laundry fixing part 32 is disposed between the base plate 120 and the press plate 110. Hence, when the press plate 110 adheres to the base plate 120, the laundry disposed between the base plate 120 and the press plate 110 is pressurized.

The press plate 110 is rotatably disposed on the door 30 or the base plate 120. One side of the press plate 110 is rotatably coupled to the door 30 or the base plate 120 and the other side of the press plate 110 is fastened to the door 30 via a switch part 112. Here, fastening the press plate 110 to the door 30 means a state that the press plate 110 is stationarily disposed to the door 30 by the switch part 112. Therefore, if the press plate 110 is unfastened from the door 30, the press plate 110 may be in a state of being rotatably disposed on the door 30.

When the press plate 110 is fastened to the door 30, the press plate 110 may pressurize the base plate 120.

On one side of the press plate 110, a hinge 119 rotatably disposing the press plate 110 to the door 30 may be disposed. On the press plate 110, a switch part 112 fastened to or unfastened from a switch counterpart 38 disposed on an inner surface 31*a* of the door 30 is disposed. The switch part 112 may use a latch switch fastened to or unfastened from the switch counterpart 38 if a pressure is applied thereto. When the switch part 112 is fastened to the switch counterpart 38, the press plate 110 may adhere to the base plate 120. When the switch part 112 is fastened to the switch counterpart 38, laundry disposed between the press plate 110 and the base plate 120 may be pressurized.

An opening 116*a* may be formed in the center of the press plate 110. Through the opening 116*a*, steam or hot air flowing in the treatment space 10*s* may flow to the laundry disposed in the press device 100.

The press plate 110 includes an opening forming plate 116 having the opening 116*a* formed in the center thereof and a pressurizing plate 114*a*/114*b* extended in right and left directions of the opening forming plate 116 to pressurize a base elastic plate 121*b*1 and 121*b*2 of the base plate 120, which will be described later. The pressurizing plate 114*a* includes a first pressurizing plate 114*a* extended from the opening forming plate 116 in one of the left and right directions and a second pressurizing plate 114*b* extended from the opening forming plate 116 in the other direction of the first pressurizing plate 114*a*.

In a lower part of the press plate 110, a fixing clip recess 118 is formed at a location corresponding to the fixing clip 40 of the door 30. The fixing clip recess 118 is formed in a manner of recessing the press plate 110 inward to prevent the press plate 110 from pressurizing the fixing clip 40 when the press plate 110 is fastened to the door 30.

The base plate 120 is mounted on the inner surface 31*a* of the door 30. The base plate 120 may include a plate having elasticity in a direction of the inner surface 31*a* of the door 30. A fastening part 126 is disposed to the center of each of top and bottom ends of the base plate 120 to be coupled to the door 30. The base plate 120 includes a base fixing plate 121*a* fixed to the door 30 and a base elastic plate 121*b*1 and 121*b*2 extended from the base fixing plate 121*a* in left and right directions and disposed in a manner of being spaced apart from the inner surface 31*a* of the door 30.

The base elastic plate 121*b*1 and 121*b*2 may include a first base elastic plate 121*b*1 and a second base elastic plate 121*b*2 pressurized by the first press plate 114*a* and the second press plate 114*b*, respectively when the press plate 110 is fastened to the door 30.

The base plate 120 may include a first surface 122 facing the treatment space 10*s* and a second surface 124 forming a surface opposite to the first surface 122, when closing the open front side of the cabinet 10. The second surface 124 is disposed to face the inner surface 31*a* of the door 30.

On the second surface 124 of the base plate 120, a stopper 130 limiting a moving range of the base plate 120 when the base plate 120 is pressurized by the press plate 110. The stopper 130 is disposed in rear of the base elastic plate 121*b*1 and 121*b*2. The stopper 130 is projected from the second surface 124 toward the inner surface 31*a* of the door 30, thereby limiting the moving range of the base elastic plate 121*b*1 and 121*b*2. On the inner surface 31*a* of the door 30, a buffer member (not shown) may be disposed at a location corresponding to the stopper 130.

On the second surface 124, a rigidity reinforcement rib 132 projected in a grid form is formed to reinforce rigidity of the base plate 120.

On one side of the base plate 120, a switch recess 128, through which the switch part 112 provided to the press plate 110 passes, is formed.

On both left and right end portions of the base plate 120, a pair of films 150*a* and 150*b* are disposed. A pair of the films 150*a* and 150*b* are rotatably disposed on both end portions on the left and right sides of the base plate 120, respectively. A pair of the films 150*a* and 150*b* may include a first film 150*a* disposed on a left end portion of the base plate 120 and a second film 150*b* disposed on a right end portion of the base plate 120.

Laundry placed on the laundry fixing part 32 may include a pair of sleeves. Here, a pair of the sleeves may mean a part formed with a pair to enclose arms or legs. Generally, when pants are placed on the laundry fixing part 32, a pair of sleeves may be disposed in the press device 100 in a manner of lying one upon another.

Each of a pair of the films 150*a* and 150*b* is disposed between a pair of sleeves of laundry. As each of a pair of the films 150*a* and 150*b* is disposed between a pair of the sleeves, it may pressurize each of a pair of the sleeves as the press plate 110 and the base plate 120 adhere closely to each other.

The film 150*a*/150*b* may be formed of a flexible material. The film 150*a*/150*b* is configured to have flex rigidity enough not to be easily bent by pressure with relatively thin thickness. The film 150*a*/150*b* may provide a compression force to the laundry disposed between the base plate 120 and the press plate 110.

The film 150*a*/150*b* may be formed of a flexible plastic material. In some implementations, the film 150*a*/150*b* may be formed of polycarbonates, polypropylene, or polyethylene terephthalate (PET).

The thickness of the film 150*a*/150*b* is 0.5~1.0 mm, which is relatively thin. As the film 150*a*/150*b* is formed relatively thin, a user can easily manipulate the film 150*a*/150*b*.

A pair of the films 150*a* and 150*b* are disposed on the left and right end portions of the base plate 120, respectively. Hence, a switch recess counterpart hole 152 corresponding to the switch recess 128 formed in both end portions on the left and right sides of the base plate 120 is formed in the films 150*a* and 150*b*.

A pair of the films 150*a* and 150*b* are fixed to brackets 140*a* and 140*b* rotatably disposed to both left and right end portions of the base plate 120, respectively. The film 150*a*/150*b* may be bonded to the bracket 140*a*/140*b* via a separate adhesive member. The bracket 140*a*/140*b* may include a first bracket 140*a*1/140*a*2 fixed to the first film 150*a* and a second bracket 140*b*1/140*b*2 fixed to the second film 150*b*.

The first bracket 140*a*1 and 140*a*2 includes a first upper bracket 140*a*1 fixed to an upper part of the first film 150*a* and a first lower bracket 140*a*2 fixed to a lower part of the first film 150*a*. The first upper bracket 140*a*1 and the first lower bracket 140*a*2 are disposed in top and bottom directions of the base plate 120 with reference to the switch recess 128, respectively.

The second bracket 140*b*1 and 140*b*2 includes a second upper bracket 140*b*1 fixed to an upper part of the second film 150*b* and a second lower bracket 140*b*2 fixed to a lower part of the second film 150*b*. The second upper bracket 140*b*1 and the second lower bracket 140*b*2 are disposed in top and bottom directions of the base plate 120 with reference to the switch recess 128, respectively.

The brackets 140*a*1, 140*a*2, 140*b*1 and 140*b*2 are connected to shafts 142*a*1, 142*a*2, 142*b*1 and 142*b*2 rotatably disposed on the second surface 124 of the base plate 120, respectively. The shafts 142*a*1, 142*a*2, 142*b*1 and 142*b*2 include first shafts 142*a*1 and 142*a*2 respectively connected to the first brackets 140*a*1 and 140*a*2 and second shafts 142*b*1 and 142*b*2 respectively connected to the second brackets 140*b*1 and 140*b*2.

Figure 5:
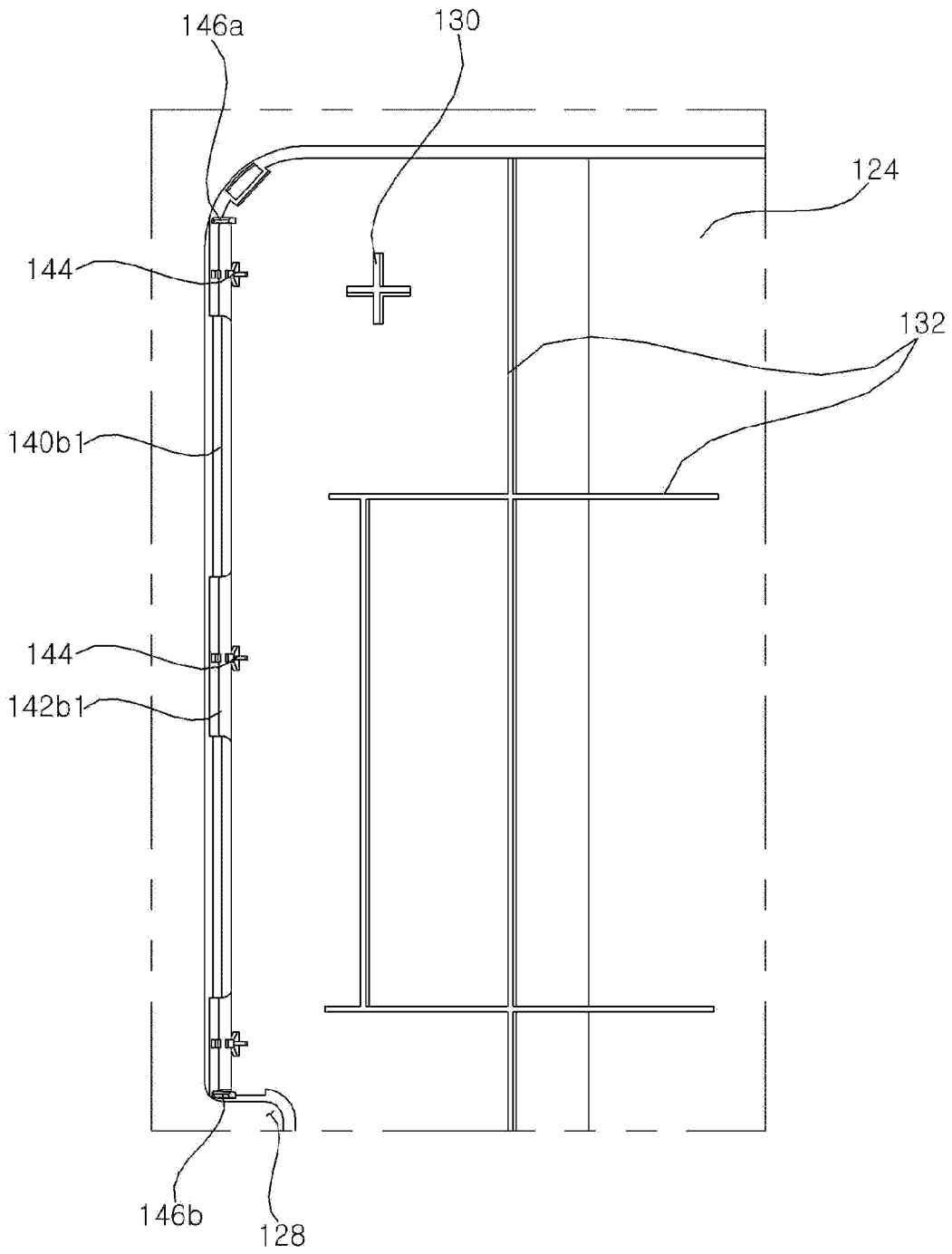
FIG. 5 is a diagram to describe a shaft and bracket disposed on a second surface of a base plate according to one embodiment of the present disclosure.

Each of the shafts 142*a*1, 142*a*2, 142*b*1 and 142*b*2 is rotatably mounted on a shift fixing member 144 formed on the second surface 124 of the base plate 120. Referring to FIG. 5, movement restricting ribs 146*a* and 146*b* restricting the shaft disposed to the shaft fixing member 144 from moving in top and bottom directions are disposed on top and bottom sides of the shaft 140*b*1, respectively. The movement restricting ribs 146*a* and 146*b* are formed in a manner of protruding from the second surface 124 of the base plate 120.

The bracket 140*a*1/140*a*2/140*b*1/140*b*2 includes an inner bracket 1401 disposed in a manner of being fixed to the shaft 142*a*1/142*a*2/142*b*1/142*b*2 on a portion where the second surface 124 of the base plate 120 is formed, an outer bracket 1403 disposed in a manner of being fixed to the film 150*a*/150*b* on a portion where the first surface 122 of the base plate 120 is formed, and a connecting bracket 1402 connecting one end portion of the inner bracket 1401 and one end portion of the outer bracket 140*a*/140*b* together.

Figure 6A:
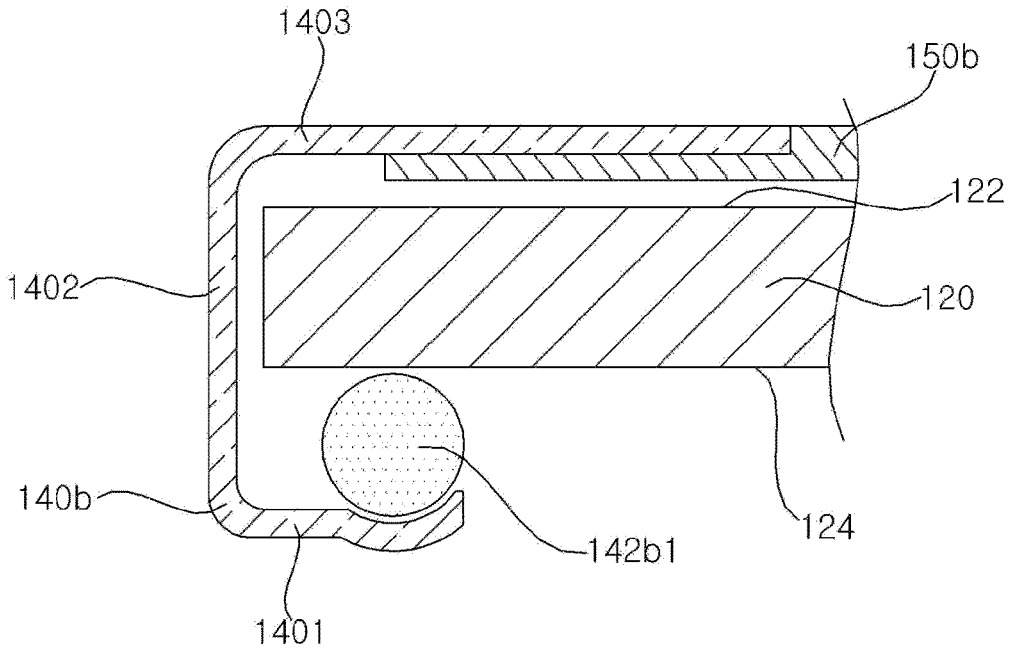
FIG. 6A is a cross-sectional diagram to describe disposition of a film and bracket at a first location according to one embodiment of the present disclosure.
Figure 6B:
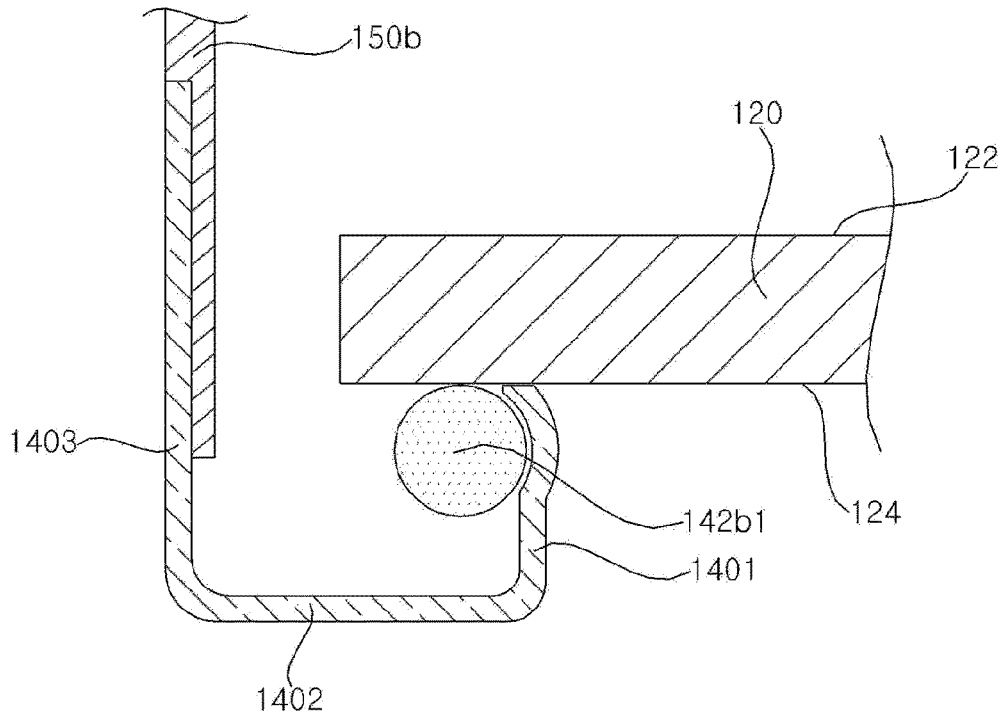
FIG. 6B is a cross-sectional diagram to describe disposition of a film and bracket at a second location according to one embodiment of the present disclosure.
Figure 7:
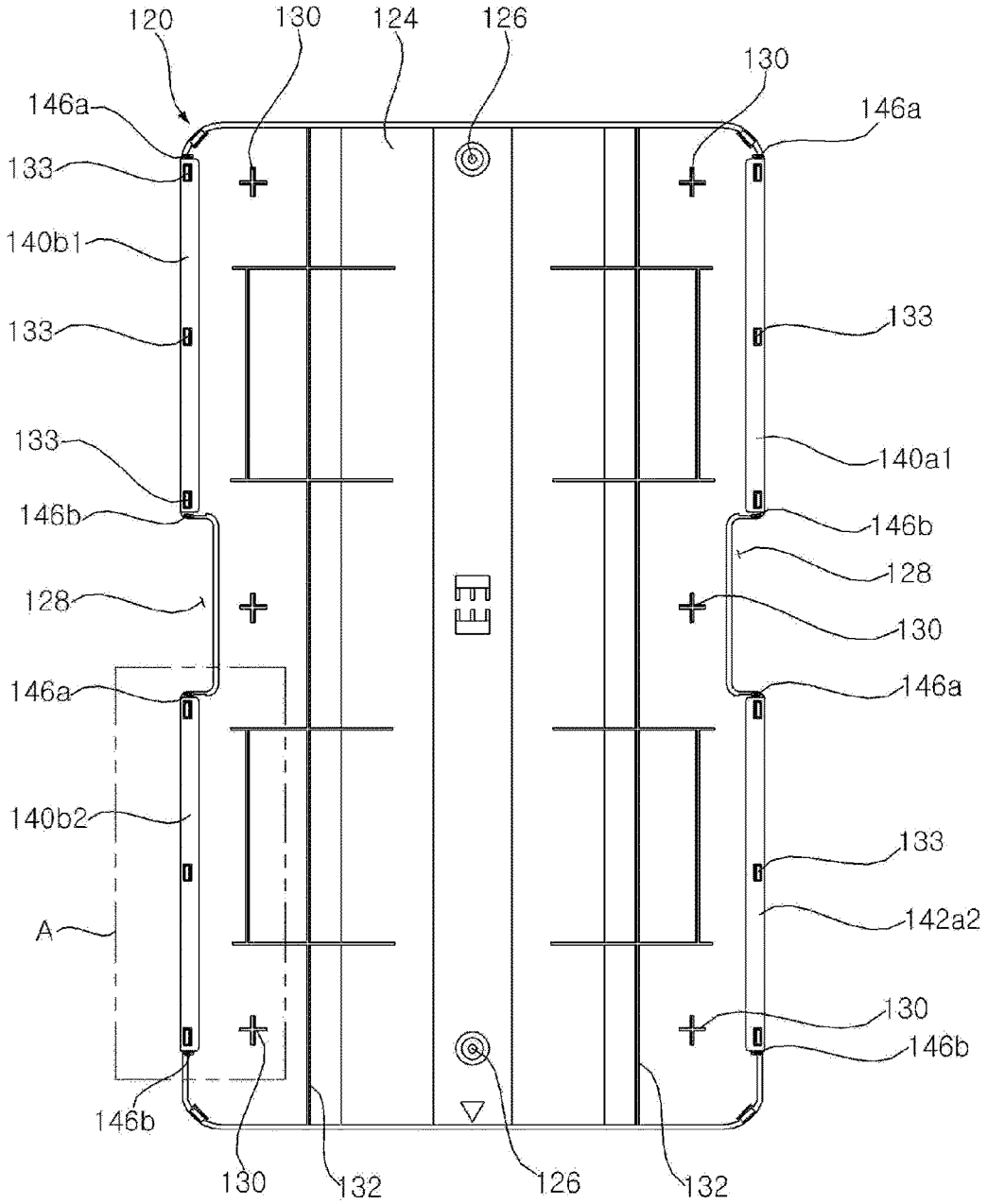
FIG. 7 is a rear diagram of a base plate according to one embodiment of the present disclosure.

Referring to FIG. 6A and FIG. 6B, the other end portion of the inner bracket 1401 rotates while being fixed to the shaft 142*b*1 and may contact with the base plate 120 depending on disposition so as to restrict the rotation range of the shaft 142*b*1.

Referring to FIG. 6A and FIG. 6B, the film 150*b* may rotate in a direction range of 90 degrees with respect to the base plate 120 by the inner bracket 1401 and the outer bracket 1403. Namely, in FIG. 6A, as the outer bracket 1403 and the film 150*b* come in contact with the first surface 122 of the base plate 120, the film 150*b* is disposed side by side with the base plate 120 so as not to further rotate. In FIG. 6B, as the inner bracket 1401 comes in contact with the second surface 124 of the base plate 120, the film 150*b* is disposed vertical to the base plate 120 so as not to further rotate.

Referring to FIG. 6A and FIG. 6B, one end portion of the outer bracket 1403 is bonded to the film 150*b* and one end portion of the inner bracket 1401 is bonded to the shaft 142*b*1. One end portion of the inner bracket 1401 may be fixed to the shaft 142*b*1 via a separate fastening means or rib.

The outer bracket 1403 and the film 150*b* may be bonded together via a separate bonding member. Regarding the portion where the outer bracket 1403 and the film 150*b* are bonded together, they may be bonded by UV (Ultraviolet Ray) bonding to withstand the high temperature inside the treatment space 10*s* and the pressure between the press plate 110 and the base plate 120.

Hereinafter, an embodiment of fixing a pair of the films 150*a* and 150*b* to the base plate 120 in another way will be described with reference to FIGS. 7 to 11B. In this case, a pair of the films 150*a* and 150*b* may be disposed in shape disclosed in FIG. 1B, FIG. 2B and FIG. 3B.

A pair of the films 150*a* and 150*b* are fixed to the brackets 140*a* and 140*b* fixed to both left and right end portions of the base plate 120, respectively. The films 150*a* and 150*b* may be bonded to the brackets 140*a* and 140*b* via separate bonding members, respectively. Regarding the portion where the bracket 140*a*/140*b* and the film 150*a*/150*b* are bonded together, they may be bonded by UV (Ultraviolet Ray) bonding to withstand the high temperature inside the treatment space 10*s* and the pressure between the press plate 110 and the base plate 120.

A pair of the films 150*a* and 150*b* are disposed on the left and right end portions of the base plate 120, respectively. Hence, a switch recess counterpart hole 152 corresponding to the switch recess 128 formed in both end portions on the left and right sides of the base plate 120 is formed in the films 150*a* and 150*b*.

The bracket 140*a*/140*b* may include a first bracket 140*a*1/140*a*2 fixed to the first film 150*a* and a second bracket 140*b*1/140*b*2 fixed to the second film 150*b*.

The first bracket 140*a*1 and 140*a*2 includes a first upper bracket 140*a*1 fixed to an upper part of the first film 150*a* and a first lower bracket 140*a*2 fixed to a lower part of the first film 150*a*. The first upper bracket 140*a*1 and the first lower bracket 140*a*2 are disposed in top and bottom directions of the base plate 120 with reference to the switch recess 128, respectively.

The second bracket 140*b*1 and 140*b*2 includes a second upper bracket 140*b*1 fixed to an upper part of the second film 150*b* and a second lower bracket 140*b*2 fixed to a lower part of the second film 150*b*. The second upper bracket 140*b*1 and the second lower bracket 140*b*2 are disposed in top and bottom directions of the base plate 120 with reference to the switch recess 128, respectively.

Figure 8:
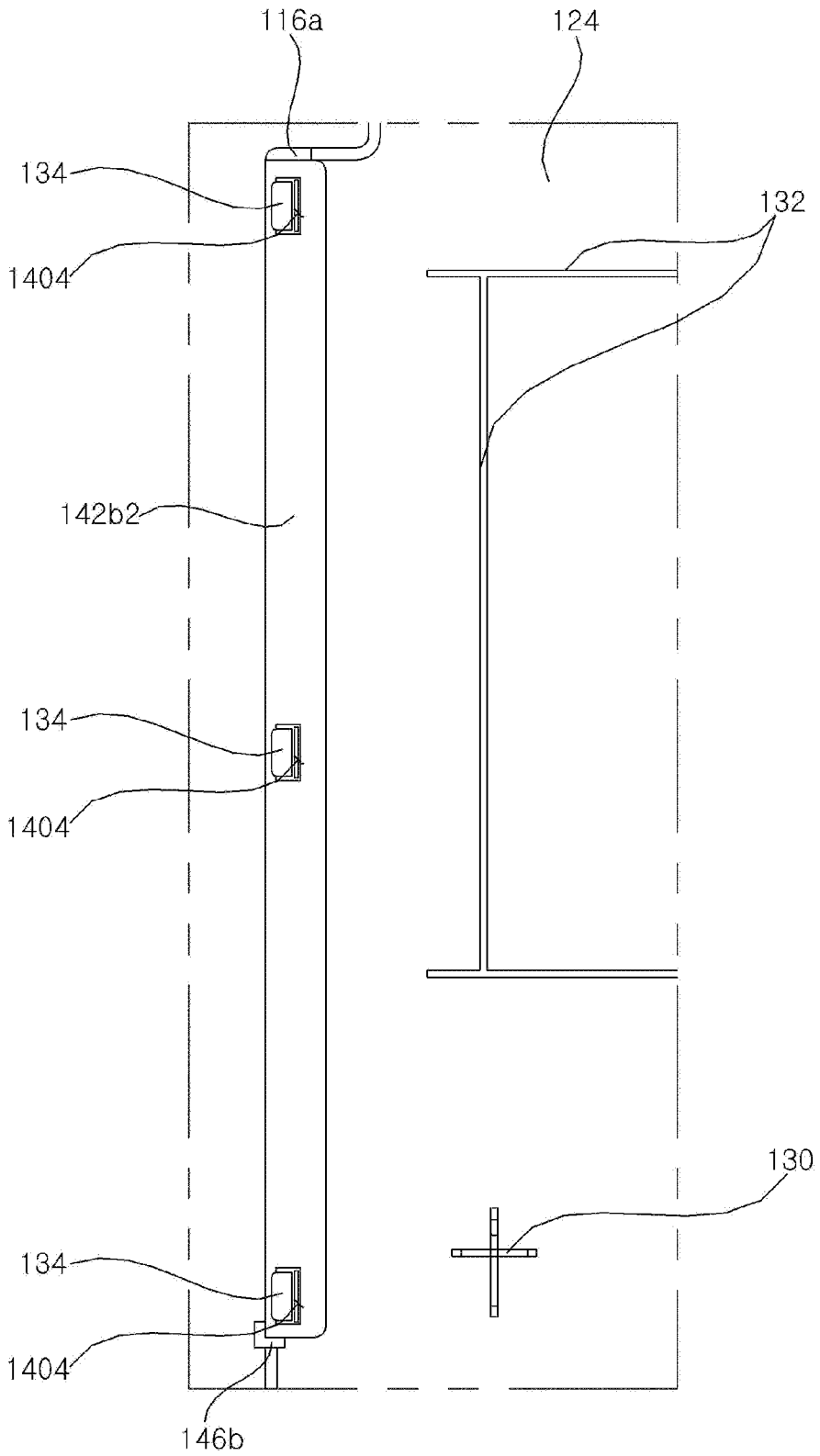
FIG. 8 is an enlarged diagram of a part A shown in FIG. 7.

Referring to FIG. 8, the bracket 140*b*2 is fitted to the fixing rib 133 formed on the base plate 120 and disposed on the base plate 120 stationarily. A plurality of fixing ribs 133, which fix the brackets 140*a*1, 140*a*2, 140*b*1 and 140*b*2 by being inserted in the brackets 140*a*1, 140*a*2, 140*b*1 and 140*b*2, respectively, are disposed on the second surface 124.

The configuration of the bracket and the relation with the base plate 120 will be described with reference to FIG. 9A and FIG. 9B. The configuration of the bracket 140*b*2 shown in FIG. 9A and FIG. 9B is applicable to other brackets 140*a*1, 140*a*2 and 140*b*1.

Figure 9A:
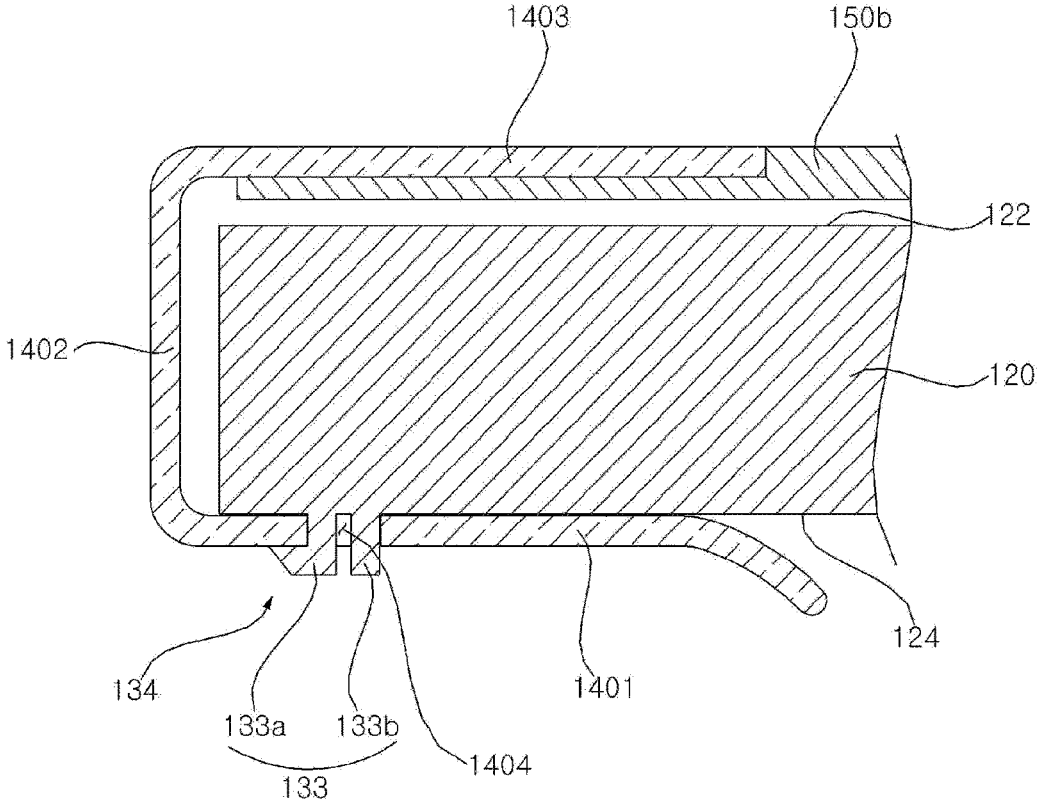
FIG. 9A is a cross-sectional diagram of a bracket mounted on a base plate to describe a configuration of the bracket according to one embodiment of the present disclosure.
Figure 9B:
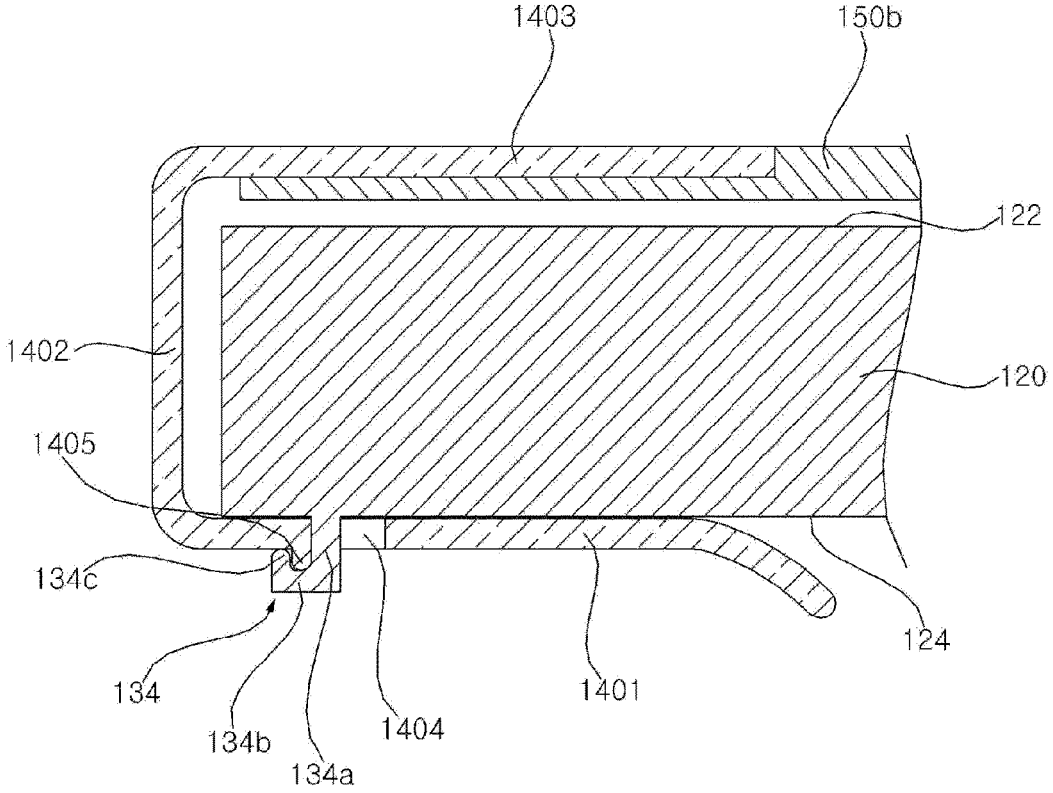
FIG. 9B is a cross-sectional diagram of a bracket mounted on a base plate to describe a configuration of the bracket according to one embodiment of the present disclosure.

Referring to FIG. 9A and FIG. 9B, the bracket 140*b*2 includes an inner bracket 1401 disposed in a manner of being fixed to the second surface 124 of the base plate 120, an outer bracket 1403 disposed in a manner of being fixed to the film 150*a*/150*b* on a portion where the first surface 122 of the base plate 120 is formed, and a connecting bracket 1402 connecting one end portion of the inner bracket 1401 and one end portion of the outer bracket 1403 together.

Referring to FIG. 9A, on the second surface 124 of the base plate 120 according to one embodiment, a fixing rib 133 fixing the bracket 140*b*2 is formed. In the bracket 140*b*2, a bracket hole 1404 in which the fixing rib 133 is inserted is formed. In the inner bracket 1401, the bracket hole 1404 in which the fixing rib 133 is inserted is formed. Here, the fixing rib 133 is coupled to the inner bracket 1401 by a hook mechanism.

Referring to FIG. 9A, the fixing rib 133 includes a hook part 133*a* caught on the inner bracket 1401 by being inserted in the bracket hole 1404 and a space maintaining part 133*b* fixing the fixing rib 133*b* inserted in the bracket hole 1404 by maintaining a space from the hook part 133*a*. Regarding the space maintaining part 133*b*, the space from the hook part 133*a* may be narrowed by a pressure applied by a user. If the pressure applied by the user is released, the space from the hook part 133*a* may be maintained.

Referring to FIG. 9B, on the second surface 124 of the base plate 120 according to another embodiment, a fixing rib 134 fixing the bracket 140*b*2 is formed. In the inner bracket 1401, a bracket hole 1404 in which the fixing rib 134 is inserted is formed.

Referring to FIG. 9B, the fixing rib 134 includes a vertical rib 134*a* vertically protruding from the second surface 124, a horizontal rib 1402 bent and extended from an end portion of the vertical rib 134*a* in a direction parallel to the inner bracket 1401, and a horizontal rib projection projected from one side of the horizontal rib 1402 in a direction facing the bracket 140*b*. When the fixing rib 134 fixes the inner bracket 140*b*, the horizontal rib projection 134*c* is disposed to come in contact with the inner bracket 1401.

Referring to FIG. 9B, the inner bracket 1401 includes a rib fixing projection 1405 protruding in a direction of the horizontal rib 134*b* to be caught on the horizontal rib projection 134*c* when the fixing rib 134 fixes the bracket 140*b*2 by passing through the bracket hole 1404 of the inner bracket 1401. When the fixing rib 134 fixes the bracket 140*b*2, the horizontal rib projection 134*c* formed at the horizontal rib 134*b* comes in contact with the inner bracket 1401 and the rib fixing projection 1405 formed at the inner bracket 1401 restricts the movement of the horizontal rib projection 134*c*, whereby the bracket 140*b*2 can be fixed to the base plate 120.

Referring to FIG. 8, on the base plate 120, movement restricting ribs 146*a* and 146*b* are formed to restrict upward and downward movements of the bracket 140*b*2 attached to the base plate 120. The movement restricting ribs 146*a* and 146*b* protrude from top and bottom sides of the bracket 140*b*2 in a direction vertical to a plane formed by the base plate 120. The movement restricting ribs 146*a* and 146*b* may protrude from the second surface 124 of the base plate 120 in a door direction or in a manner of enclosing the connecting bracket 1402.

Hereinafter, a bracket 160 according to another embodiment of the present disclosure will be described with reference to FIG. 10, FIG. 11A and FIG. 11B. A plurality of brackets 160 described in FIG. 10, FIG. 11A and FIG. 11B may be disposed at the same locations of the brackets 140*a*1, 140*a*2, 140*b*1 and 140*b*2 shown in FIG. 7. For convenience of description, it will be described by distinguished reference numbers, and in the case of the base plate 120, a structure performing the same function will be described by the same reference number.

Figure 10:
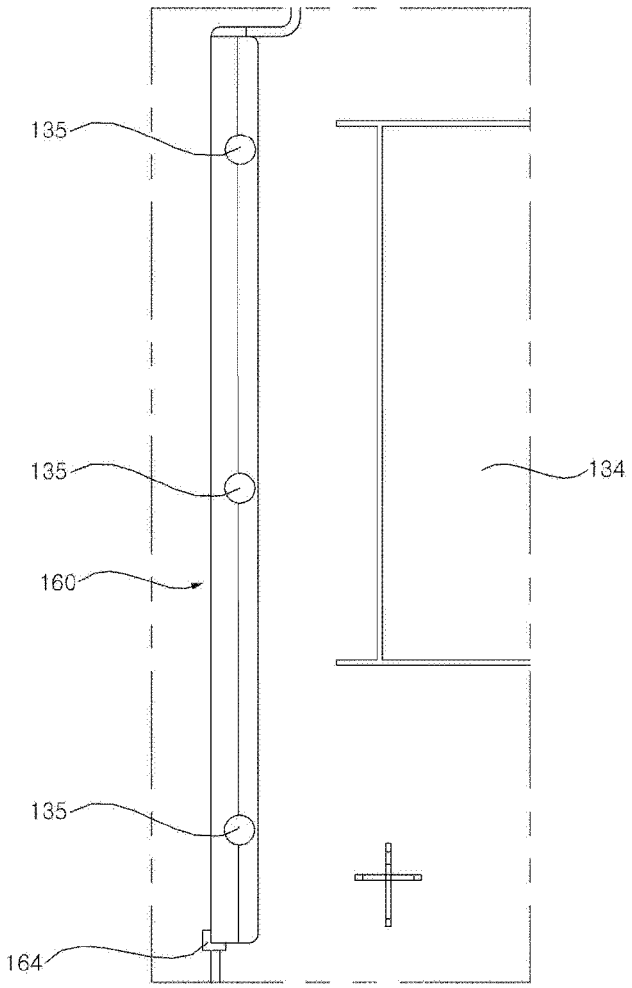
FIG. 10 is a diagram to describe a bracket mounted on a base plate according to one embodiment of the present disclosure.
Figure 11A:
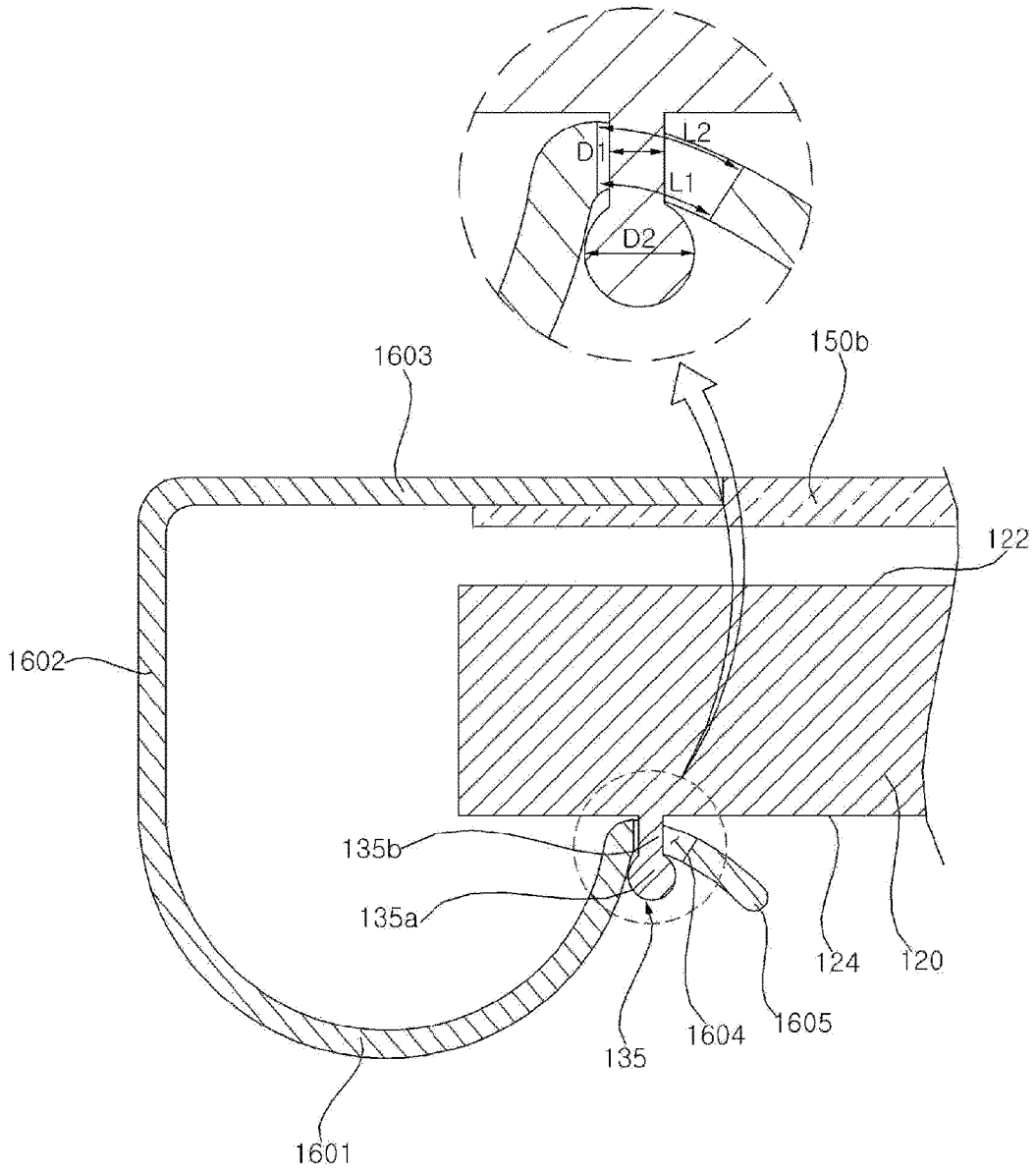
FIG. 11A and FIG. 11B are diagrams to describe a state that a bracket is mounted on a base plate regarding the relation between disposition and configuration of the bracket.
Figure 11B:
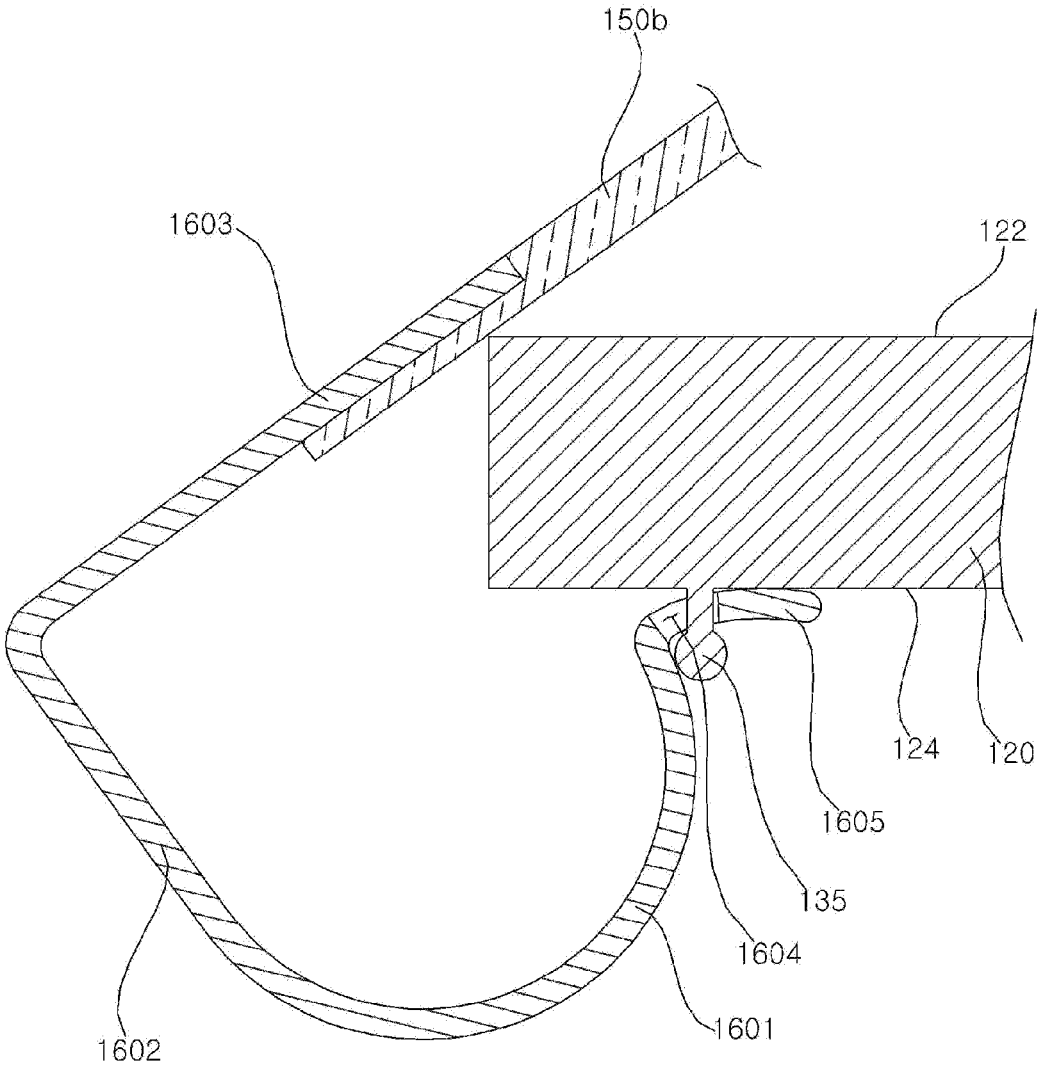

Referring to FIG. 10, FIG. 11A and FIG. 11B, a bracket 160 according to another embodiment of the present disclosure may be fixed to the base plate 120 in a manner of being rotatable in a predetermined range. Namely, the disposition of the film 150*a*/150*b* disposed on the first surface 122 of the base plate 120 can be changed in a predetermined range.

Referring to FIG. 10, on the base plate 120 according to the present disclosure, a movement restricting rib 164 restricting the upward/downward movement of the bracket 160 attached to the base plate 120 may be disposed.

Referring to FIG. 11A and FIG. 11B, the bracket 160 includes an outer bracket 1603 disposed on the first surface 122 of the base plate 120 and connected to the film 150*a*/150*b*, an inner bracket 1601 rotatably fixed to the second surface 124 of the base plate 120, and a connecting bracket 1602 connecting the outer bracket 1603 and the inner bracket 1601 together.

The bracket 160 includes a bracket stopper 1605 extended in a direction in which the door 30 is disposed by being bent at an end portion of the inner bracket 1601 to restrict a rotatable range of the bracket 160.

The outer bracket 1603 is connected to the film 150*a*/150*b* and forms a straight surface parallel to the first surface 122. The outer bracket 1603 may be disposed parallel to the base plate 120 according to a disposition change of the inner bracket 1601, or may be disposed inclined to the base plate 120.

The inner bracket 1601 may have a semicircular shape convex to the outside of the second surface 124. The bracket stopper 1605 extends from an end portion of the inner bracket 1601.

A fixing projection 135 connected to the bracket 160 is formed on the second surface 124 of the base plate 120, and a bracket hole 1604 in which the fixing projection is inserted is formed at an end portion of the inner bracket 1601.

The fixing projection 135 includes a fixing projection body 135*a* projected from the second surface 124 in a direction of the door 30 and disposed in a manner of passing through the bracket hole 1604 and a fixing projection head 135*b* formed at an end portion of the fixing projection body 135*a* to prevent separation of the bracket 160 mounted on the fixing projection 135. A width D2 of the fixing projection head 135*b* is formed greater than a width D1 of the fixing projection body 135*a*. A width of the bracket hole 1604 may have a shape that becomes narrower if getting far away from the base plate 120. A width L2 of an inner end portion of the bracket hole 1604 disposed close to the base plate 120 is formed greater than a width L1 of an outer end portion of the bracket hole 1604. The width D2 of the fixing projection head 135*b* is formed greater than the width L1 of the outer end portion of the bracket hole 1604.

Referring to FIG. 11A and FIG. 11B, since the inner bracket 1601 has a curved shape and a diameter of the bracket hole 1604 is formed greater than a width of the fixing projection 135, the bracket 160 may move rotatably in a predetermined range with respect to the base plate 120. Yet, as the bracket stopper 1605 formed at the end portion of the inner bracket 1601 comes into contact with the second surface 124 of the base plate 120, the rotatable range of the bracket 160 may be restricted.

As shown in FIG. 11A, at a first position where the film 150*a*/150*b* is disposed parallel to the base plate 120, the bracket stopper 1605 forms an inclination angle with respect to the base plate 120 in an acute angle range. Accordingly, as shown in FIG. 11B, at a second position where the bracket stopper 1605 comes in contact with the base plate 120, the film 150*a*/150*b* may form an inclination angle in an acute angle range with respect to the base plate 120. The range of the acute angle may be formed in a range of 30 to 60 degrees.

In some implementations, referring to FIGS. 1A to 3B, the films 150*a* and 150*b* may be provided in various shapes.

Figure 2A:
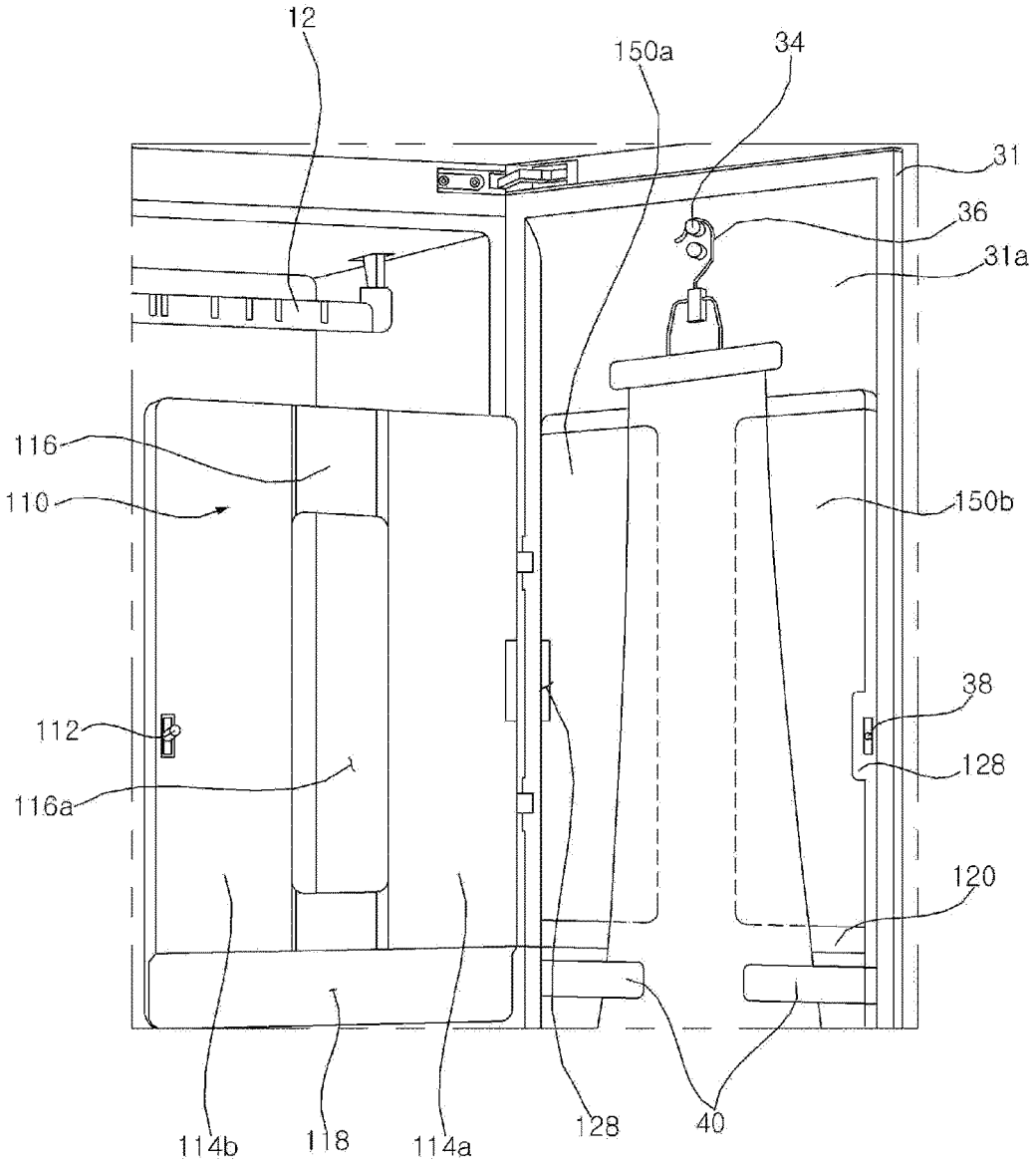
FIG. 2A is a perspective diagram to describe a press device according to one embodiment of the present disclosure, in which a press plate is unfastened from a door.
Figure 3A:
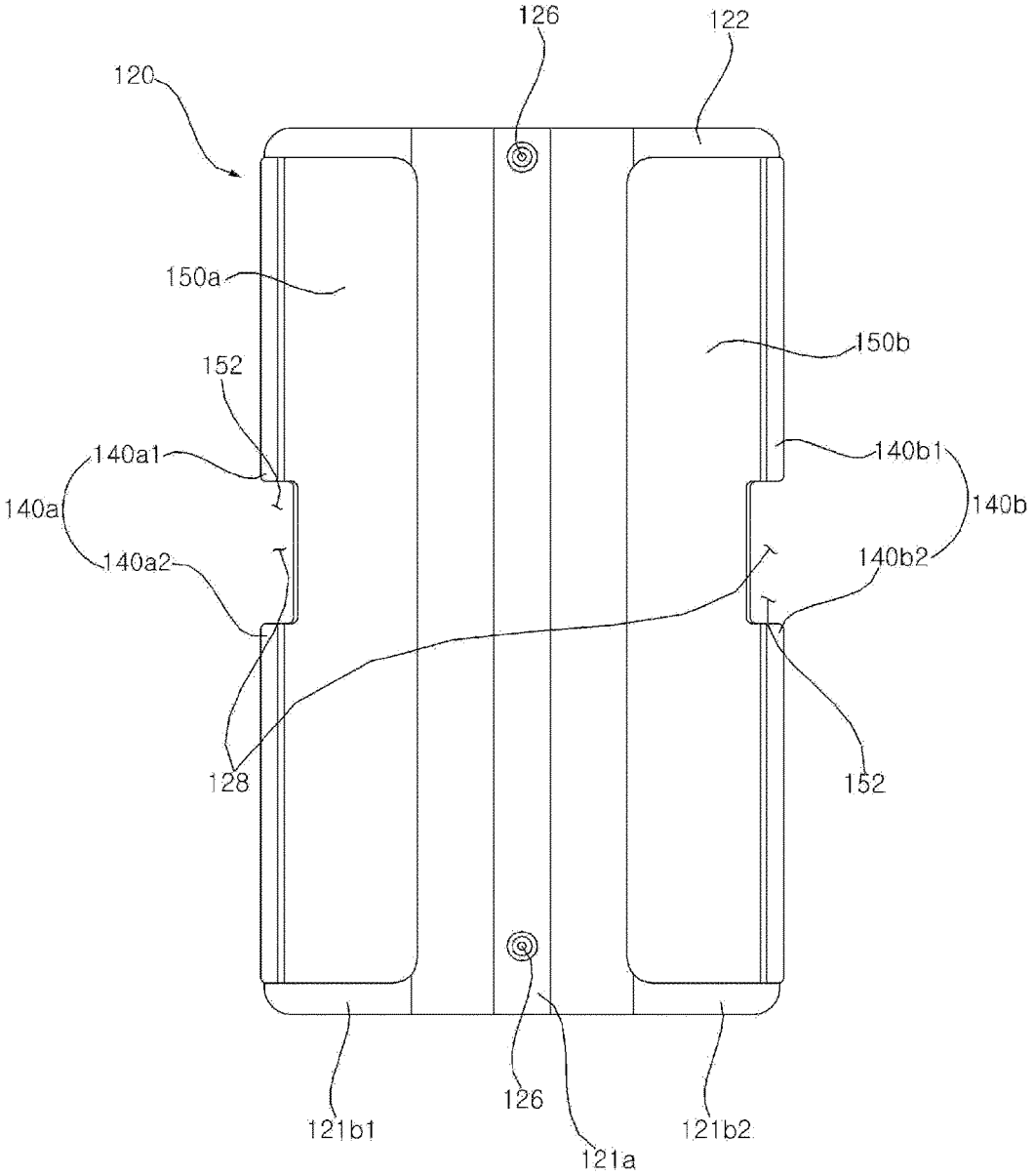
FIG. 3A is a front diagram of a base plate having a film disposed thereon according to one embodiment of the present disclosure.

Specifically, referring to FIGS. 1A, 2A, and 3A, each of a pair of films 150*a* and 150*b* may include a horizontal extension part extending in a width direction of the door and a vertical extension part extending from the horizontal extension part in a height direction of the door. In this case, each of a pair of films 150*a* and 150*b* may have an approximately rectangular shape. Therefore, when a pair of the films 150*a* and 150*b* are rotatably provided on the base plate 120, a user can ensure a contact area between the film 150*a*/150*b* and laundry while easily positioning a pair of the films 150*a* and 150*b* between the laundry.

Figure 1B:
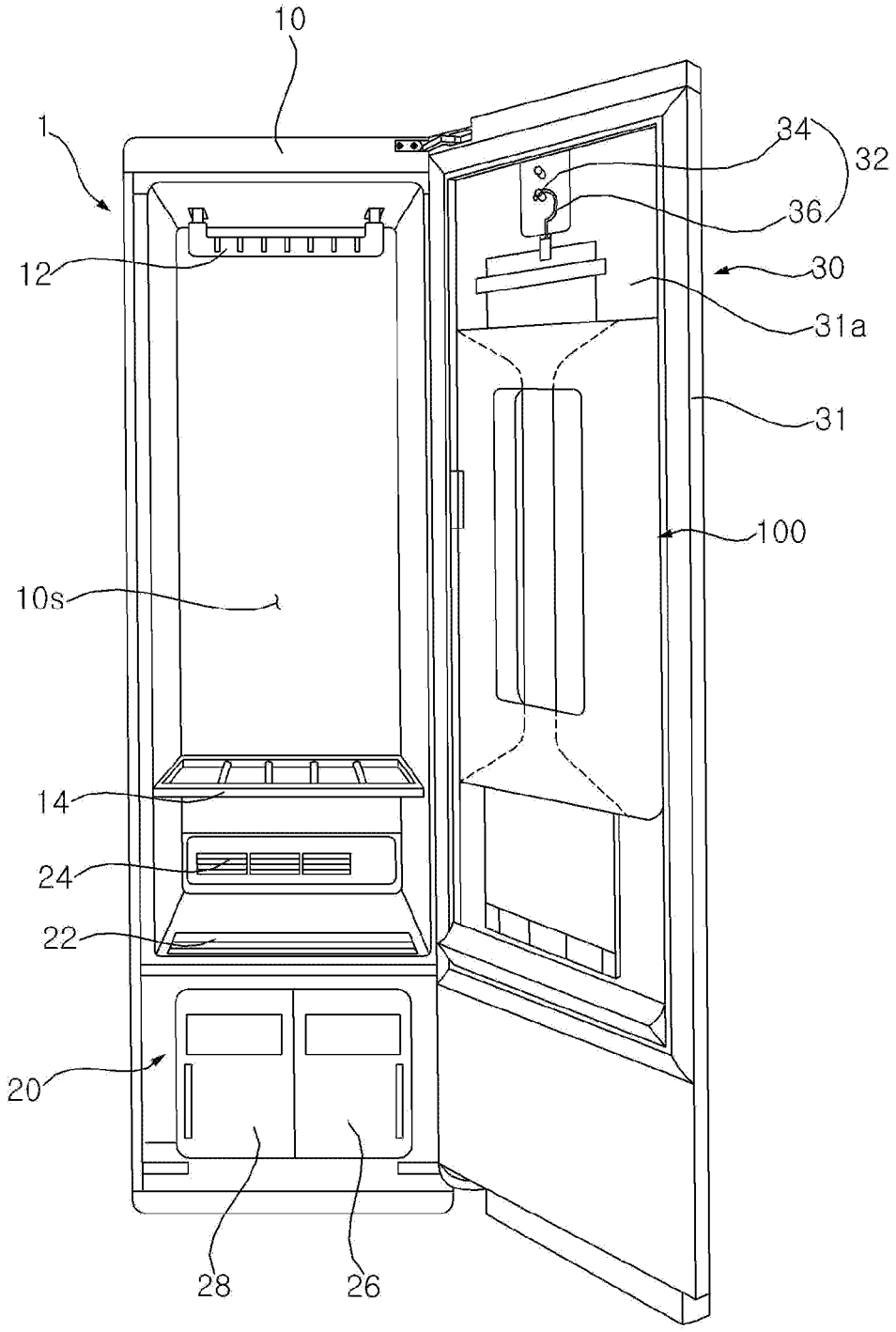
FIG. 1B is a perspective diagram of a laundry treatment apparatus in which a film in a shape different from that shown in FIG. 1A is disposed.
Figure 2B:
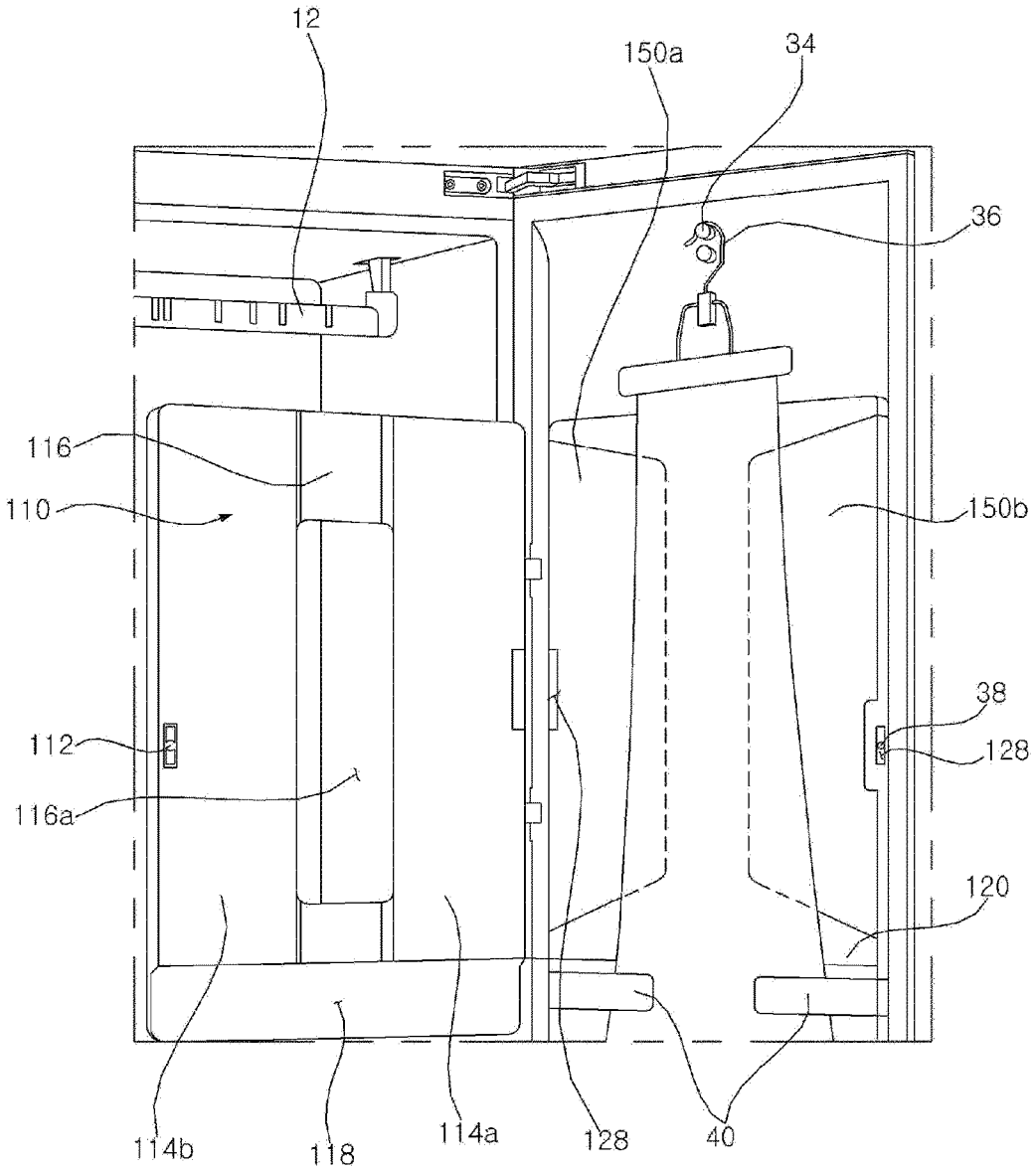
FIG. 2B is a perspective diagram showing that a film different from that shown in FIG. 2A is disposed.
Figure 3B:
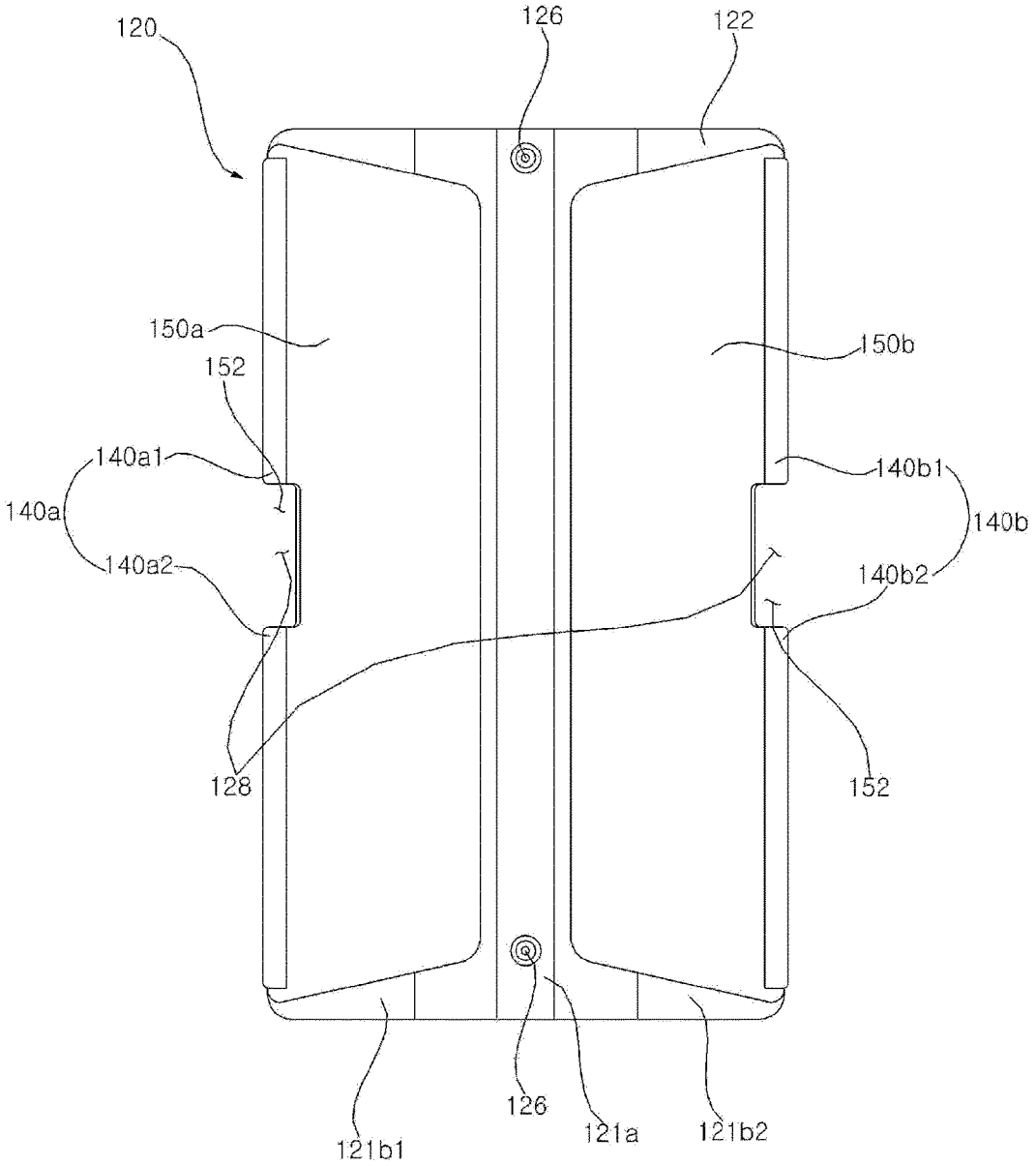
FIG. 3B is a front diagram of a base plate on which a film in a shape different from that shown in FIG. 3A is disposed.
Figure 4:
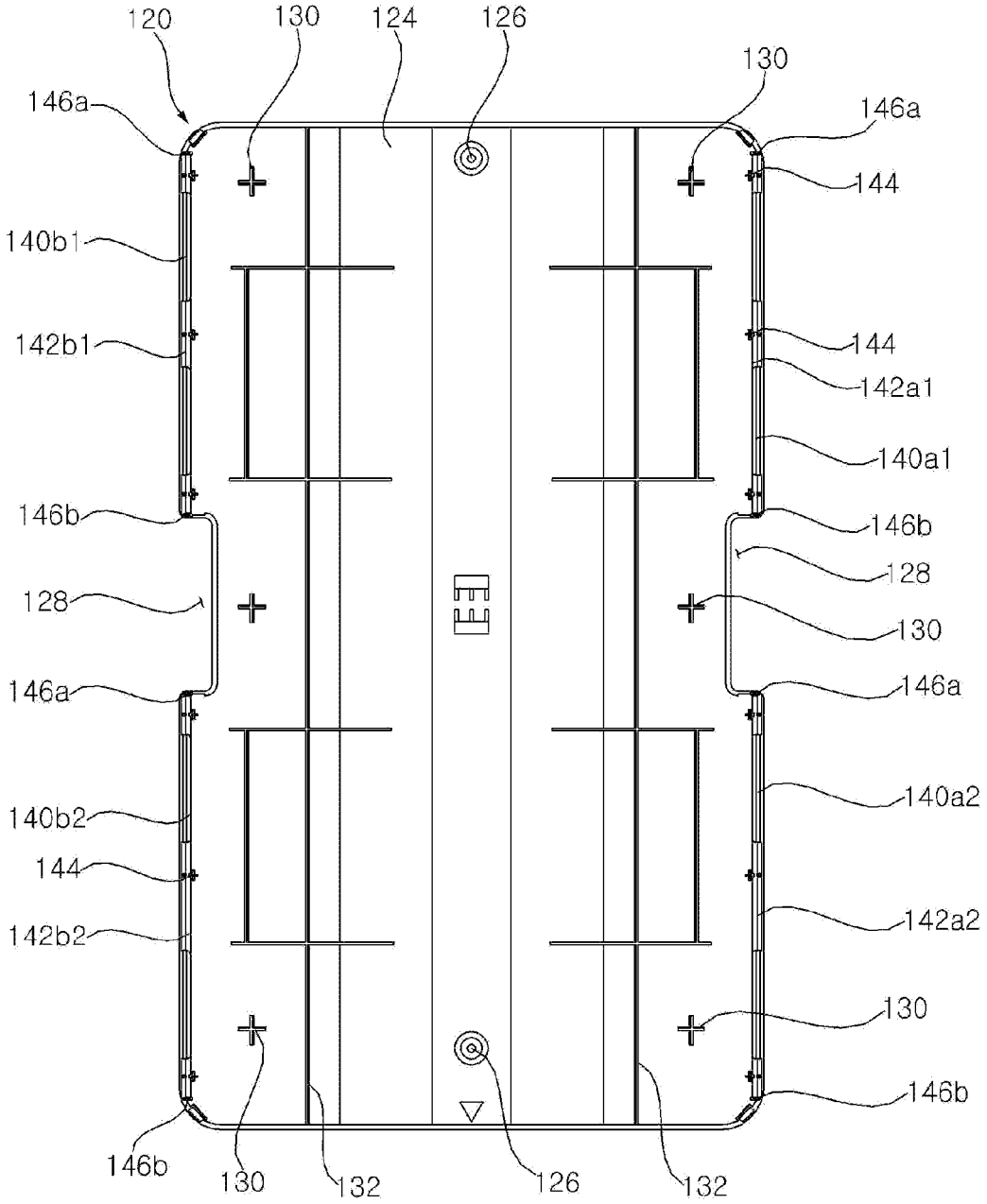
FIG. 4 is a rear diagram of a base plate according to one embodiment of the present disclosure.

In addition, referring to FIGS. 1B, 2B, and 3B, each of a pair of the films 150*a* and 150*b* may include a vertical extension part spaced apart from a portion fixed to the base plate 120 and extending in a height direction of the door 30 and an inclined part extending from the vertical extension part toward a portion at which each of a pair of the films 150*a* and 150*b* is fixed to the bae plate 120. In this case, each of a pair of the films 150*a* and 150*b* may have an approximately trapezoidal shape.

The inclined part may be inclined such that each of a pair of the films 150*a* and 150*b* extends from the vertical extension part toward the portion at which each of a pair of the films 150*a* and 150*b* is fixed to the base plate 120 in a manner of being inclined downward or upward.

So to speak, the inclined part may be connected to the vertical extension part in a manner of being inclined upward or downward at the portion of each of a pair of the films 150*a* and 150*b* fixed to the base plate.

In this case, a user may smoothly position the films 150*a* and 150*b* between the laundry even though a pair of the films 150*a* and 150*b* are fixed not to rotate on the base plate 120.

While the preferred embodiment of the present disclosure has been illustrated and described above, the present disclosure is not limited to the specific embodiment described above, and various modifications can be implemented by those skilled in the art to which the present disclosure pertains without departing from the gist of the present invention. And, such modifications should not be individually understood from the technical spirit or prospect of the present disclosure.

What is claimed is:

1. An apparatus for treating laundry, comprising:

a cabinet that defines a treatment space configured to receive the laundry therein and an open front side;

a door configured to open and close the open front side of the cabinet; and a press device disposed on an inner surface of the door facing the treatment space and configured to pressurize the laundry, the press device comprising:

a base plate disposed on the inner surface of the door to support one side of the laundry, a press plate hinged to the door and configured to press the laundry supported on the base plate toward the base plate, a first bracket disposed at a left end portion of the base plate and coupled to the base plate at a rear side of the base plate, a first film disposed between the press plate and the base plate and fixed to the first bracket, a second bracket disposed at a right end portion of the base plate and coupled to the base plate at the rear side of the base plate, and a second film disposed between the press plate and the base plate and fixed to the second bracket.

2. The apparatus of claim 1, wherein the first bracket and the second bracket comprise:

an inner bracket disposed on the rear side of the base plate to be fixed to the base plate;

a connecting bracket extended from the inner bracket toward a front side of the base plate; and an outer bracket extended from the connecting bracket to facing the front side of the base plate.

3. The apparatus of claim 2, wherein a first curved portion is disposed between the inner bracket and the connecting bracket, and a second curved portion is disposed between the connecting bracket and the outer bracket.

4. The apparatus of claim 2, wherein the first film and the second film are disposed between the outer bracket and the base plate.

5. The apparatus of claim 3, wherein the first film is adhered to the outer bracket of the first bracket, and the second film is adhered to the outer bracket of the second bracket.

6. The apparatus of claim 1, wherein at least one of the first film or the second film is made of a flexible material.

7. The apparatus of claim 2, wherein:

a first fixing rib is formed on the left end portion of the rear side of the base plate;

a second fixing rib is formed on the right end portion of the rear side of the base plate;

the first bracket has a first bracket hole to which the first fixing rib is inserted; and the second bracket has a second bracket hole to which the second fixing rib is inserted.

8. The apparatus of claim 2, wherein:

a first fixing rib is formed on the left end portion of the rear side of the base plate;

a second fixing rib is formed on the right end portion of the rear side of the base plate;

the inner bracket of the first bracket has a first bracket hole to which the first fixing rib is inserted; and the inner bracket of the second bracket has a second bracket hole to which the second fixing rib is inserted.

9. The apparatus of claim 8, wherein the first fixing rib and the second fixing rib are coupled to the inner bracket by a hook mechanism.

10. The apparatus of claim 8, wherein the first fixing rib and the second fixing rib comprise:

a vertical rib extended from the base plate toward the door to pass through a corresponding bracket hole among the first bracket hole and the second bracket hole;

a horizontal rib extended parallel to a surface formed by the inner bracket in a manner of being bent at an end portion of the vertical rib; and a horizontal rib projection that projects from one side of the horizontal rib in a direction facing the inner bracket, and wherein the horizontal rib projection comes in contact with the inner bracket.

11. The apparatus of claim 1, wherein a right side of the first film and a left side of the second film are spaced apart from each other.

12. The apparatus of claim 11, wherein a film recess is defined at a left side of the first film and a right side of the second film.

13. The apparatus of claim 12, wherein the first bracket includes:

a first upper bracket disposed at upper than the film recess; and a first lower bracket disposed at lower than the film recess, and wherein the second bracket includes:

a second upper bracket disposed at upper than the film recess, and a second lower bracket disposed at lower than the film recess.

14. The apparatus of claim 12, wherein the base plate defines a recess at a left side of the base plate and a right side of the base plate, and wherein the recess is defined at a position corresponding to the film recess.

15. The apparatus of claim 14, wherein the first bracket includes:

a first upper bracket disposed at upper than the recess; and a first lower bracket disposed at lower than the recess, and wherein the second bracket includes:

a second upper bracket disposed at upper than the recess, and a second lower bracket disposed at lower than the recess.

16. The apparatus of claim 15, further comprising a switch part configured to fasten the press plate to the door, wherein the switch part is disposed within the recess.

17. The apparatus of claim 10, wherein a film recess is defined at a left side of the first film and a right side of the second film.

* * * * *